US006625292B2

(12) United States Patent
Proni

(10) Patent No.: US 6,625,292 B2
(45) Date of Patent: Sep. 23, 2003

(54) PORTED LOUDSPEAKER ENCLOSURE

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 0 days.

(21) Appl. No.: 09/991,192

(22) Filed: Nov. 15, 2001

(65) Prior Publication Data

US 2003/0091206 A1 May 15, 2003

(51) Int. Cl.[7] ..... H04R 25/00
(52) U.S. Cl. ..... 381/350; 381/349; 381/345
(58) Field of Search ..... 181/145, 155, 181/189, 184, 156, 154, 199; 381/349, 86, 335, 350, 160

(56) References Cited

U.S. PATENT DOCUMENTS

| | | | | |
|---|---|---|---|---|
| 2,694,463 A | * | 11/1954 | Robbins et al. | |
| 3,727,719 A | | 4/1973 | Yando | 181/31 B |
| 5,004,066 A | | 4/1991 | Furukawa | 181/160 |
| 5,025,885 A | | 6/1991 | Froeschle | 181/156 |
| 5,111,905 A | | 5/1992 | Rodgers | 181/152 |
| 5,189,706 A | | 2/1993 | Saeki | 381/159 |
| 5,197,103 A | | 3/1993 | Hayakawa | 181/152 |
| 5,266,752 A | | 11/1993 | Cussans | 181/155 |
| 5,432,860 A | * | 7/1995 | Kasajima et al. | |
| 5,637,840 A | | 6/1997 | Kim | 181/152 |
| 5,825,900 A | | 10/1998 | Jeon | 381/154 |
| 5,975,236 A | * | 11/1999 | Yamamoto et al. | |
| 6,104,823 A | | 8/2000 | Tanaka | 381/345 |

* cited by examiner

*Primary Examiner*—Sinh Tran
(74) *Attorney, Agent, or Firm*—Holland & Knight LLP

(57) ABSTRACT

An enclosure for one or more loudspeakers includes a housing having a top panel, a bottom panel, a front panel, a back panel and opposed end panels collectively defining a hollow interior which is open at an aperture formed in one of the panels. A baffle is mounted within the housing interior which supports one or more loudspeakers and forms a port to direct sound radiating from the back of the speakers to the aperture. All of the panels, and at least the portion of the baffle which is visible through the aperture, are covered with carpeting to provide a finished appearance for mounting of the enclosure within the interior of a vehicle.

18 Claims, 6 Drawing Sheets

PORTED LOUDSPEAKER ENCLOSURE

FIELD OF THE INVENTION

This invention relates to enclosures for loudspeakers, and, more particularly, to a ported enclosure for one or more loudspeakers in which sound emanating from opposite ends of the loudspeaker(s) is transmitted to an aperture by a baffle which mounts the loudspeaker(s) in the enclosure and forms a port with the panels of the enclosure. Each of the panels, and at least a portion of the baffle which can be seen through the aperture, are covered with carpeting to provide a finished appearance for mounting in the interior of a vehicle.

BACKGROUND OF THE INVENTION

Audio systems are standard equipment in most vehicles, and they typically include a radio, compact disc player and a number of loudspeakers such as tweeters, mid-range speakers and woofers. The quality of the sound obtained from vehicle audio systems is dependent, in large part, on the loudspeakers which are used in the system. More expensive vehicles tend to be provided with upgraded speakers and more of them, while comparatively inferior speakers are used as standard equipment in other vehicles.

Many individuals, and particularly those with good home audio systems, have come to insist on improved sound quality in their vehicle audio systems so that the music they listen to in a truck or car sounds reasonably close to the way it does at home. This demand has fueled the development of after market audio systems for vehicles in which many of the original components of the vehicle's audio system, and especially the loudspeakers, are replaced with better quality components. Additionally, new components are introduced in many after market systems such as subwoofer loudspeakers which are intended to reproduce low frequency sound thus freeing the woofers and mid-range speakers of the system to reproduce only the higher frequencies for which they are primarily designed.

The addition of subwoofers to vehicle audio systems has improved overall sound quality but also presented some difficulties, particularly in how such speakers are located in the vehicle. Because subwoofers are ordinarily not included as part of original vehicle audio systems, there is usually no location within the vehicle which has been specifically designed by the manufacturer to mount same. As a result, enclosures or cabinets for subwoofers have been developed which for some vehicles have a custom configuration to fit a particular space, and for other vehicles are constructed to mount in the trunk area or the like. In either case, most enclosures for subwoofers have panels whose exterior surfaces are covered with carpeting to provide a durable finish and blend well with the vehicle environment.

One method of fabricating enclosures for subwoofers or other speakers is known as the "wrap" method. It is designed to simplify the attachment of carpeting to the enclosure panels while making it easy to connect the panels to one another. The wrap method generally comprises initially cutting out four side panels, e.g., the top, bottom, front and back sides of the enclosure, and forming beveled edges along the length of each one. The ends of the side panels are also formed with grooves or dados to mount the end panels of the enclosure as described below. The side panels are affixed by glue or the like to a continuous length of carpeting so that their beveled edges are located adjacent to one another. The panels are then "folded" together, with glue introduced along their beveled edges, to form a rectangular shape which is held in place by the carpeting. Before the rectangular shape is closed, the end panels are affixed by glue within the grooves at the ends of the side panels. When the last side panel is folded into place, the two edges that border the carpet ends are glued and nailed together. As such, only one seam is mechanically fastened, while all of the other seams or panel connections are held in place by the glue and carpeting.

Loudspeaker enclosures made with the wrap method or by other techniques sometimes include a "port" or vent consisting of a duct or length of pipe inserted within the enclosure interior which causes the volume of air inside the enclosure to acoustically resonate at a particular frequency. This resonance frequency is determined by the internal volume of the enclosure and the diameter and length of the port. Ports are usually constructed from lengths of plastic pipe, or a duct can be built into the structure of the enclosure itself. The cross sectional area of the port must be chosen to pass sufficient volume of air in and out of the enclosure without creating turbulence which can contaminate the sound output.

In high power applications, larger port cross sections are often needed to pass increased volumes of air. In turn, it is often necessary to increase the length of the port to maintain the same system resonance frequency with a larger port cross section. The overall length of the port is limited by the depth of the enclosure since the inwardly extending end of the port must be spaced from the rear enclosure boundary so that flow is not restricted and the port resonates properly. Consequently, ports are often constructed with a bend in the pipe or a duct built into the enclosure. Both of these alternatives add time, complexity and cost to the enclosure construction.

One particular type of ported loudspeaker enclosure is disclosed in U.S. Pat. No. 5,025,885 to Froeschle. This enclosure is rectangular in cross section having a front wall, back wall, top wall, bottom wall and opposed end walls collectively defining a hollow interior which is divided into front and rear chambers by a partition. The partition mounts a loudspeaker in position to face the front wall, and also mounts a first port tube which extends between the two chambers. A second port tube is mounted in the front wall of the enclosure which extends into the front chamber.

Ported enclosures of the type disclosed in the U.S. Pat. No. 5,025,885 patent are commonly referred to as "band pass" enclosures because the front chamber and front port, through which all radiation from the loudspeaker must pass, acoustically filter the high frequency output of the system. Such effect occurs since the front port, coupled to the front chamber, resonates at a given frequency thus allowing only certain frequencies to pass from the enclosure into the listening environment. The front port is therefore specifically designed to act as a resonance-tuning device in the frequency range of interest.

Regardless of the method of fabricating a ported loudspeaker, or whether or not it is considered to constitute a band pass enclosure, it is necessary to "dress" or finish the appearance of the inside of the enclosure in the area of the port because one can see directly into the enclosure interior through the port. The appearance of unfinished wood within the enclosure interior is aesthetically unacceptable. Although attempts have been made to cosmetically treat this area, such as with the use of paint or a laminated covering, these solutions add expense and additional time to the enclosure construction.

SUMMARY OF THE INVENTION

It is therefore among the objectives of this invention to provide an enclosure for a loudspeaker which is visually acceptable in the environment of a vehicle, which is economical to fabricate, and which effectively transmits sound produced by loudspeakers mounted therein externally of the enclosure.

These objectives are accomplished in an enclosure for one or more loudspeakers which includes a housing having a top panel, a bottom panel, a front panel, a back panel and opposed end panels collectively defining a hollow interior which is open at an aperture formed in one of the panels. A baffle is mounted within the housing interior which supports one or more loudspeakers to form a port which directs sound radiating from both the front and back of the loudspeaker(s), or only the back of such speaker(s), to the aperture. All of the panels, and the baffle, are covered with carpeting to provide a finished appearance for mounting of the enclosure within the interior of a vehicle.

In the presently preferred embodiment, the wrap method described above is used to cover the top, bottom, front, back and opposed ends of the housing of the enclosure with carpeting. A baffle structure, which mounts one or more speakers within the housing interior, is covered with carpeting in a separate operation and then connected to the top or bottom panel before the panels of the housing are "folded" together. This ensures that the portion of the enclosure interior which can be seen through the aperture also has a finished appearance. When the panels are interconnected as described above, the baffle structure is affixed between the top and bottom panels such that the loudspeaker(s) mounted thereto are positioned to direct sound from the front and back of the loudspeaker, or only the back thereof, toward the aperture formed in the housing.

As is well known, movement of the diaphragm of a loudspeaker in an axial direction produces sound waves which propagate in opposite directions, i.e., toward the "front" of the speaker where the diaphragm is mounted and toward the motor structure at the "back" of the speaker. One embodiment of this invention involves the construction and orientation of a baffle within the interior of the enclosure so that the sound produced in both the front and back directions is transmitted to the aperture. Preferably, the baffle mounts one or more speakers in position relative to the aperture so that sound emanating from the front of the speaker(s) is directed to the aperture. Additionally, the baffle is located with respect to the panels of the enclosure so that a space is formed therebetween. This space provides a port along which sound emanating from the back of the speaker is directed toward the aperture. Consequently, the sound produced by the diaphragm in both the front and back directions is combined in the area of the aperture and exits the speaker enclosure together to enhance the overall sound produced by the speaker. The embodiment of this invention described above is referred to as a "ported" enclosure in view of the formation of a port for transmitting sound emanating from the back of the loudspeaker to an aperture at the front of the enclosure. In enclosures of this general type, a "roll-off" or decrease in sound pressure level occurs at a particular low frequency, depending upon the specific construction of the port and enclosures, whereas the sound pressure level remains essentially constant at higher frequencies. The term "sound pressure level" as used herein refers to what would be perceived as loudness by a user of the speaker. A "band-pass" enclosure, on the other hand, exhibits a roll-off in sound pressure levels at both a particular low frequency and high frequency. As such, the sound pressure level is maximized over a predetermined frequency range which is chosen for a particular speaker and application.

In an alternative embodiment of this invention, a band-pass enclosure is provided in which a baffle structure supporting one or more speakers is mounted within the enclosure interior forming a closed cavity at the front of the speaker and a flow path defined by the baffle and walls of the enclosure within which sound propagating from the back of the speaker is transmitted to an aperture at the front of the enclosure. Sound produced at the front of the speaker is confined by the closed cavity. The baffle structure includes a transparent section, visible through the aperture at the front of the enclosure, which forms part of the closed cavity. Additionally, other portions of the baffle structure which are visible are covered with carpeting employing the wrap method noted above.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
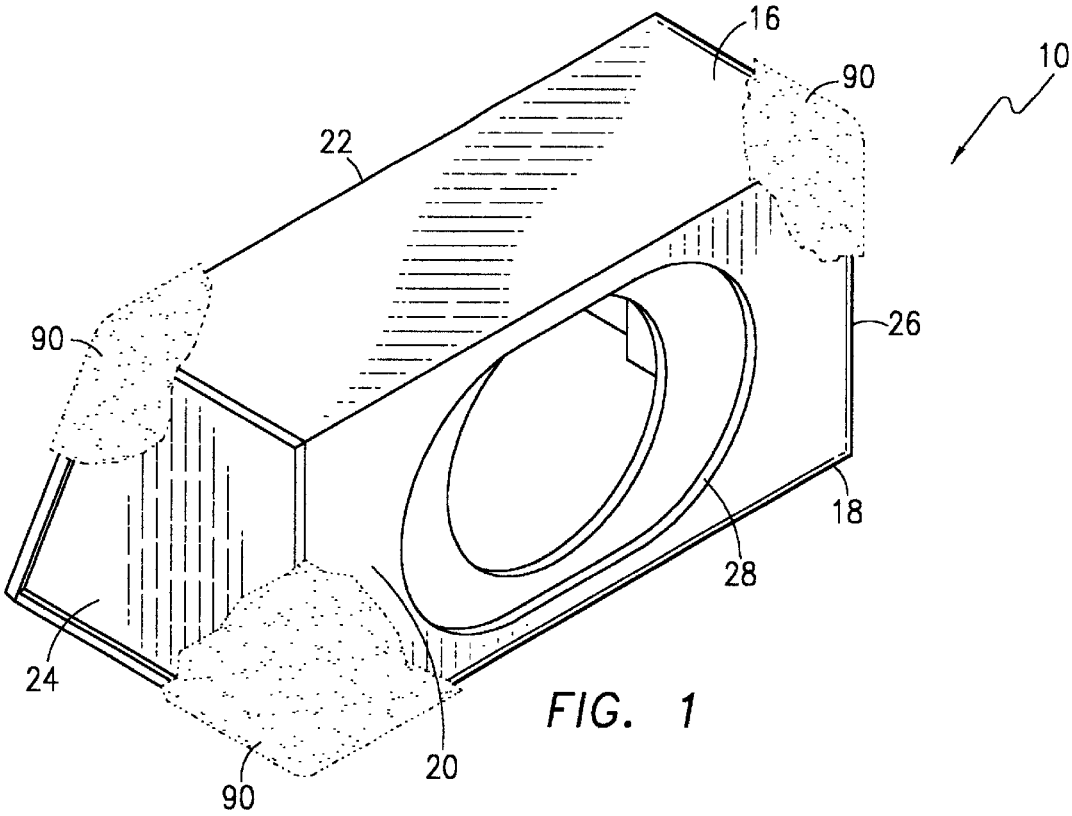
FIG. 1 is a perspective view of one embodiment of a ported enclosure of this invention.
Figure 2:
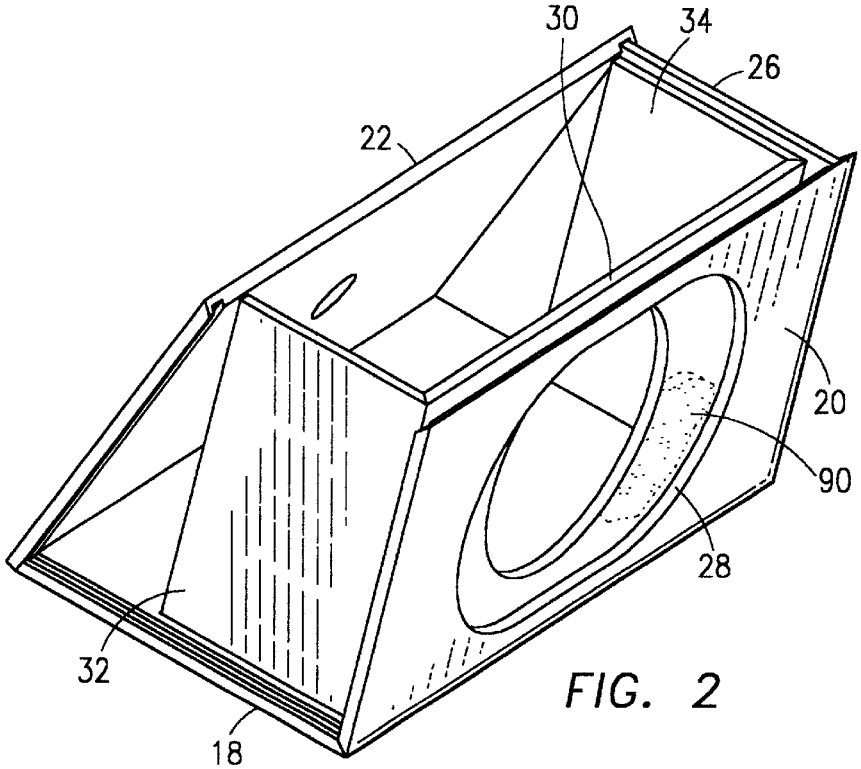
FIG. 2 is a view similar to FIG. 1, except with the top panel removed.
Figure 3:
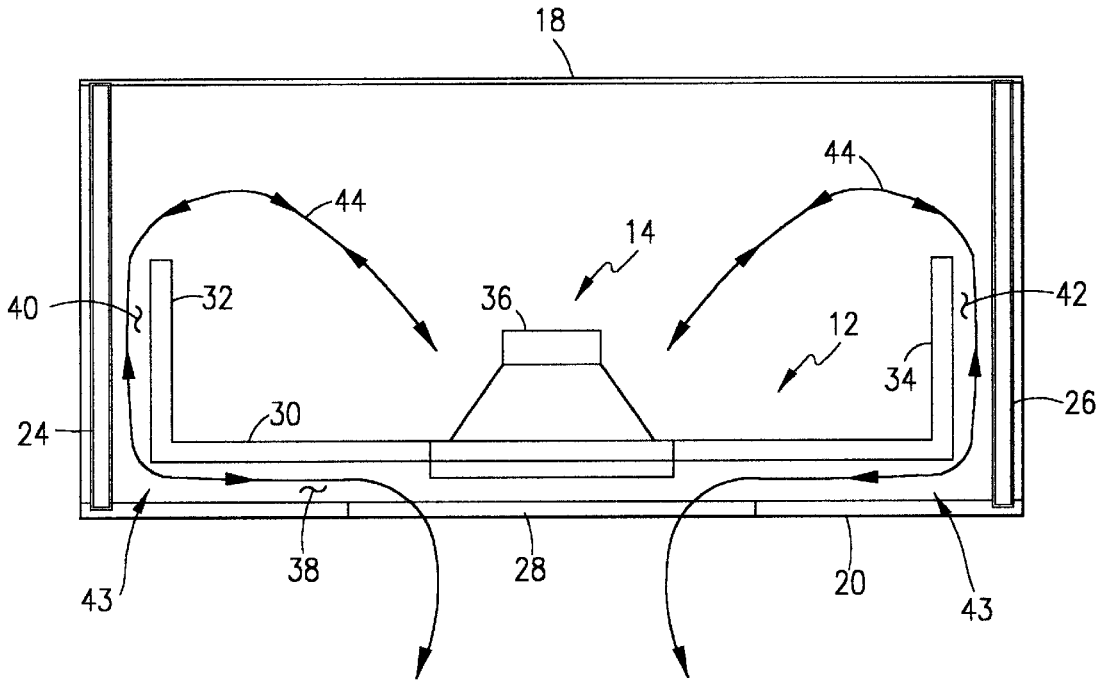
FIG. 3 is a schematic plan view of FIG. 1 with the top panel and rear panel removed, which depicts a baffle mounting a single loudspeaker.

Referring initially to FIGS. 1–3, one embodiment of a ported enclosure for a loudspeaker according to this invention comprises a housing 10 and an internal baffle 12 which mounts a single loudspeaker 14. The housing 10 includes a top panel 16, a bottom panel 18, a front panel 20, a back panel 22 and opposed end panels 24 and 26 all interconnected by the wrap method described above to form a hollow interior. For purposes of the present discussion, the term "top" refers to the vertically upward direction as the housing 10 is oriented in the Figures, while "bottom" refers to the opposite direction. The front panel 20 is formed with an opening or aperture 28 as shown.

In the embodiment of FIGS. 1–3, the baffle 12 is generally U-shaped and includes a front wall 30 which is connected at one end to a side wall 32 and at the opposite end to a side wall 34. Each of the walls 30, 32 and 34 are mounted to the bottom panel 18 of the housing and extend upwardly to the top panel 16 where they are also affixed. As best seen in FIG. 3, the front wall 30 of baffle 12 mounts a single loudspeaker 14 directly in alignment with the aperture 28 formed in the front panel 20 of housing 10. Sound propagating from the "front" of the speaker 14, i.e., where the diaphragm (not shown) is located, is thus transmitted directly out of the housing 10 through the aperture 28. As noted above, sound is also produced by the loudspeaker 14 in a direction toward the "back" of the speaker 14 where the motor structure 36 is located as schematically depicted in FIG. 3. In order to transmit this sound to the aperture 28, the baffle 12 is spaced from the panels of the housing 10 to form a port 43 therebetween. Specifically, the front wall 30 of baffle 12 is separated by a space 38 from the front panel 20 of housing 10, a space 40 is provided between the side wall 32 of the baffle 12 and the end panel 24, and, the end wall 34 and end panel 26 are separated by a space 42. The spaces 38, 40 and 42 collectively form a port 43 to direct sound emanating from the back of the speaker 14 to the aperture 28 in front panel 20 for combination with the sound propagating from the front of the speaker 14. See arrows 44 in FIG. 3. In this manner, the overall sound production of the speaker 14 is enhanced.

Figure 4:
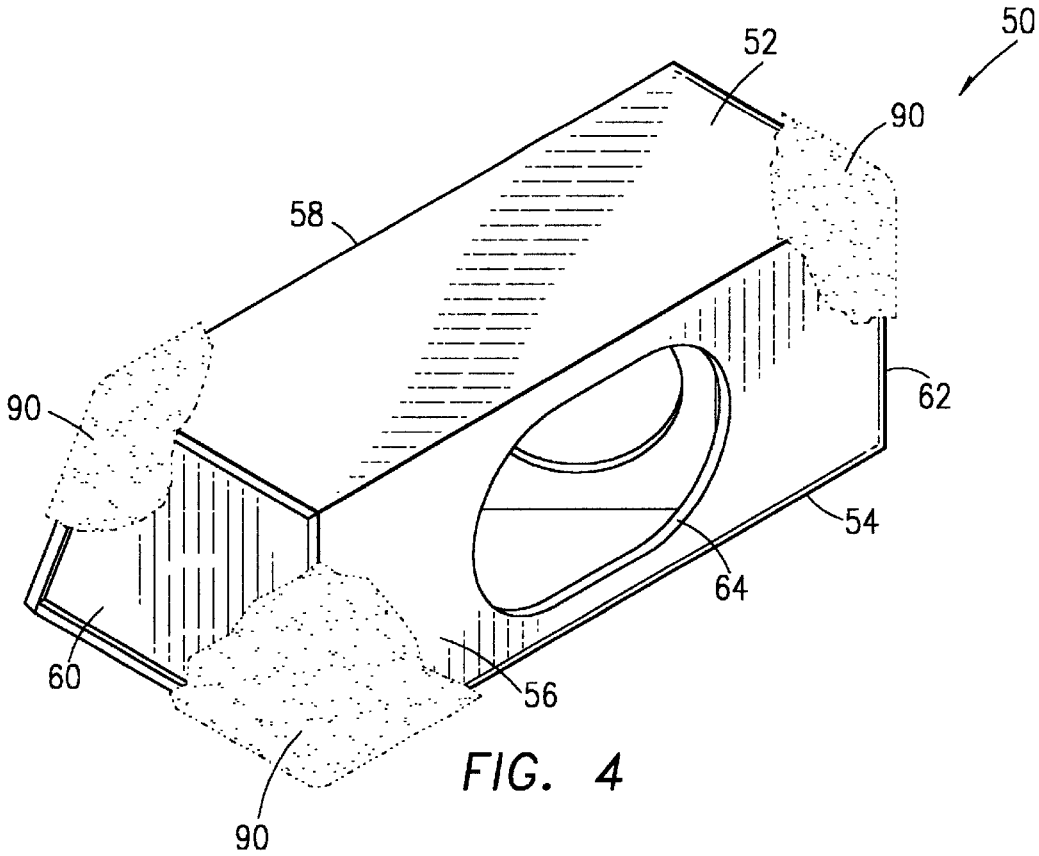
FIG. 4 is a perspective view of an alternative embodiment of a ported enclosure according to this invention.
Figure 5:
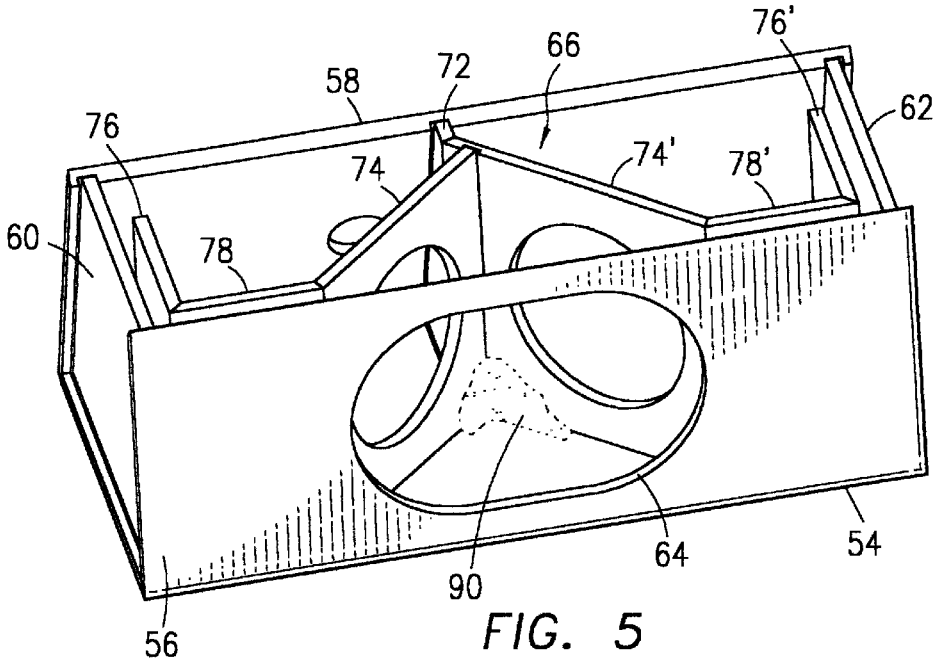
FIG. 5. is a view similar to FIG. 4, except with the top panel removed.
Figure 6:
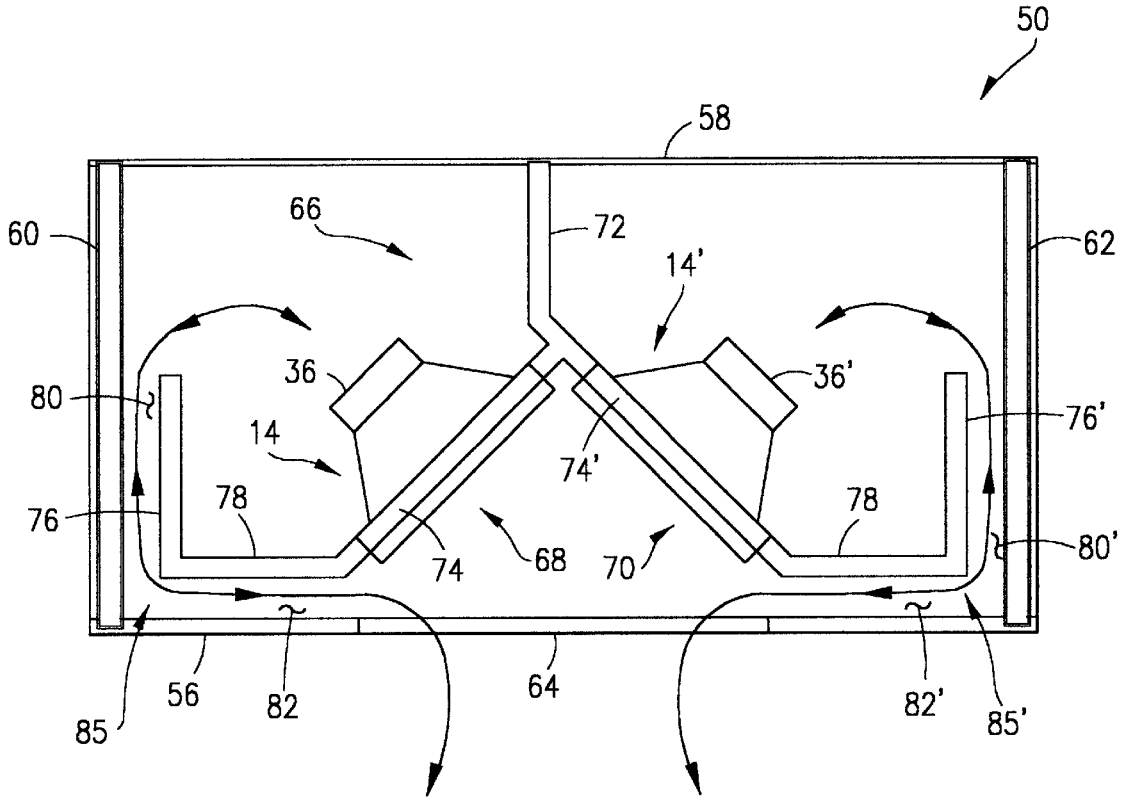
FIG. 6 is a schematic plan view of FIG. 1 with the top panel and back panel removed, which depicts a baffle mounting two loudspeakers.

Referring now to FIGS. 4–6, an alternative embodiment of a ported enclosure according to this invention is shown in which two loudspeakers 14 are mounted within the interior of the enclosure. Preferably, the enclosure comprises a housing 50 having a top panel 52, a bottom panel 54, a front panel 56, a back panel 58 and opposed end panels 60, 62 all interconnected by the wrap method described above to form a hollow interior. The front panel 56 is formed with an opening or aperture 64.

In order to mount a pair of speakers 14 within the housing 50, a baffle 66 is provided which differs in construction from the baffle 12 depicted in FIGS. 1–3. Preferably, the baffle 66 comprises a first speaker mounting section 68 and a second speaker mounting section 70 which meet at a common wall 72 connected at one end to the back panel 58 of the housing 50. Each of the speaker mounting sections 68 and 70 are essentially identical in construction, and therefore only section 68 is described in detail with the same reference numbers being used to identify the same structure in section 70 with the addition of a "'".

The first speaker mounting section 68 includes a tapered wall 74 extending from the common wall 72, an end wall 76 oriented generally parallel to and spaced from the end panel 60 of the housing 50, and, an intermediate wall 78 connected between the tapered wall 74 and end wall 76 in position spaced from and generally parallel to the front panel 56 of the housing 50. Each of the walls 74, 76 and 78 of the first speaker mounting section 68, as well as the common wall 66, extend between the top panel 52 and bottom panel 54 of the housing 50 where they are connected by glue or the like.

The tapered wall 74 mounts the speaker 14 in position generally opposite the aperture 64 formed in the front panel 56 to direct sound propagating from the front of speaker 14 toward the aperture 64. In order to direct the sound emanating in a direction toward the back of speaker 14 to the aperture 64, a port 85 is formed between each of the speaker mounting sections 68, 70 and the panels of the housing 50. As best seen in FIG. 6, the common wall 66 effectively divides the interior of housing 50 into two compartments, one for the first speaker mounting section 68 and its speaker 14 and the other for the second speaker mounting section 70 and speaker 14'. The end wall 76 of first speaker mounting section 68 is separated from the end panel 60 of housing 50 forming a space 80, and a space 82 is provided between the intermediate wall 78 of first speaker mounting section 68 and the front panel 56 of the housing 50. These spaces 80 and 82 of first speaker mounting section 68, as well as the corresponding spaces 80' and 82' of the second speaker mounting section 68, collectively form ports 85 and 85' from the back of speakers 14, 14' to the aperture 64. See arrows 84, 84' in FIG. 3. The sound transmitted along such ports 85, 85' is combined with the sound produced from the front of the speakers 14, 14' to enhance to overall sound quality.

Figure 7:
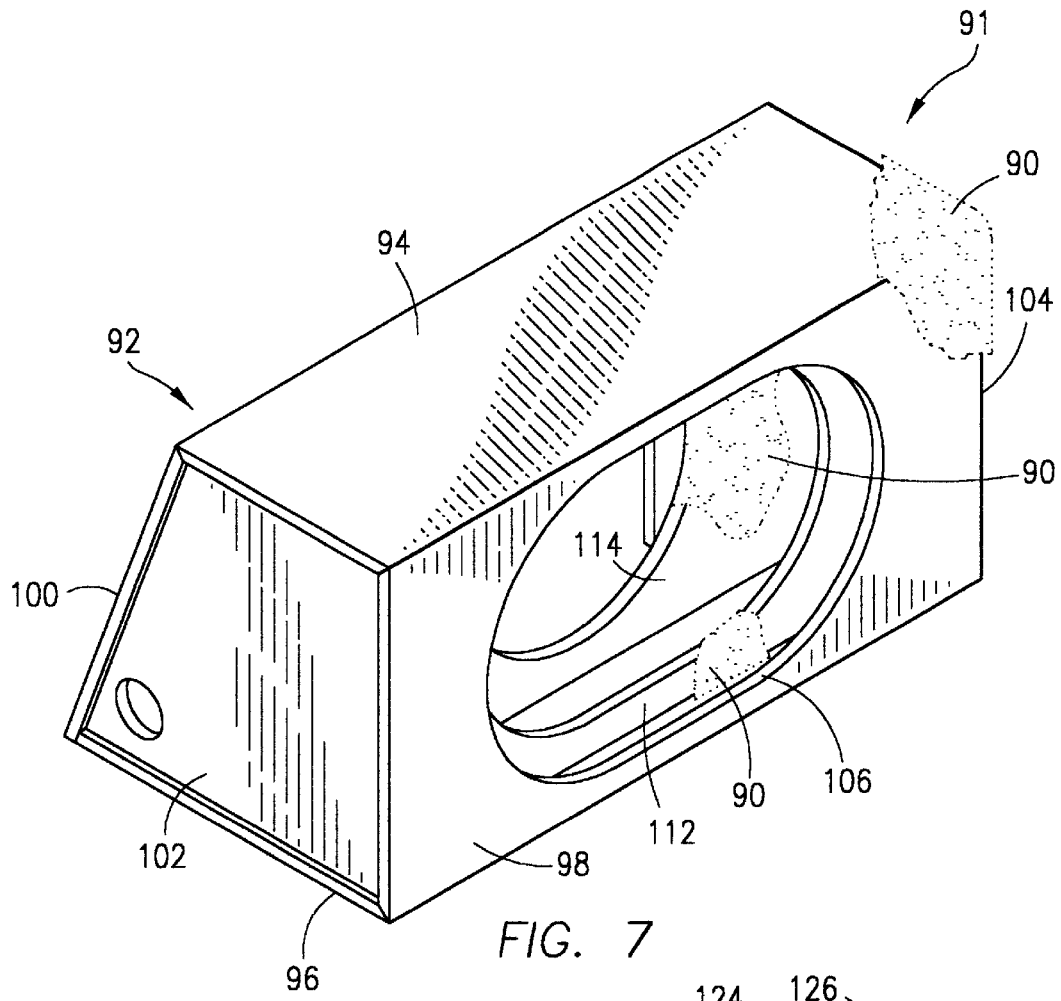
FIG. 7 is a perspective view of a band-pass enclosure according to this invention.
Figure 8:
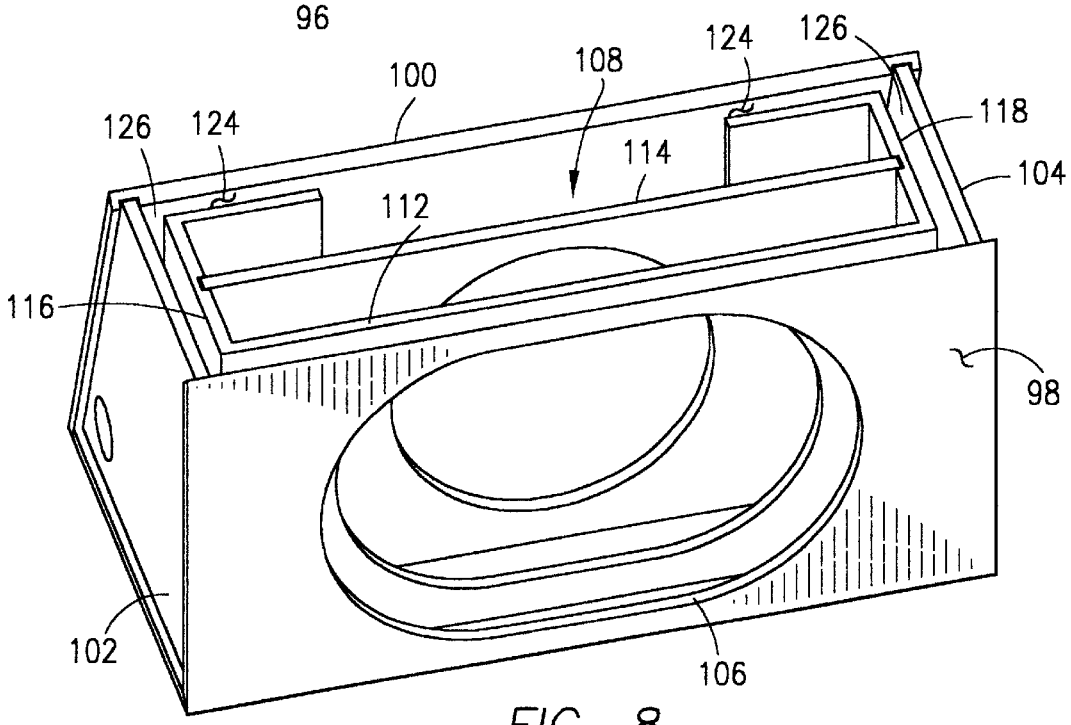
FIG. 8 is a view similar to FIG. 7 except with the top panel removed.
Figure 9:
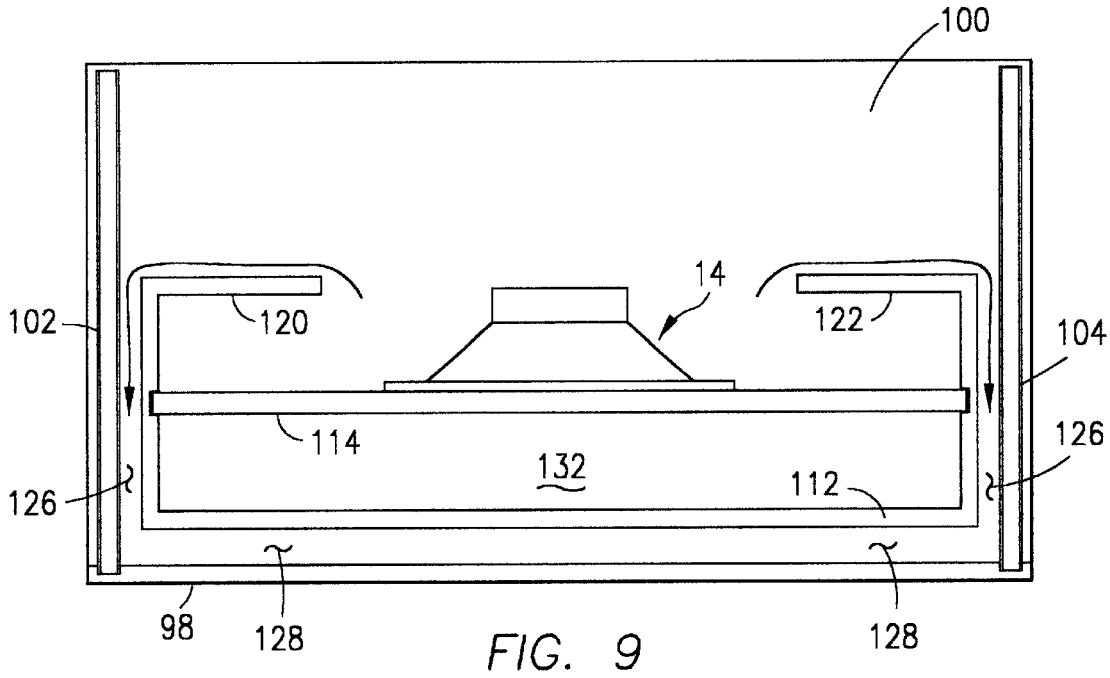
FIG. 9 is a plan view of FIG. 8 with the front panel and back panel removed.

A still further embodiment is shown in FIGS. 7–9 in which a band pass enclosure 91 according to this invention is depicted. The enclosure 91 comprises a housing 92 having a top panel 94, a bottom panel 96, a front panel 98, a back panel 100 and opposed end panels 102, 104 all interconnected by the wrap method noted above to form a hollow interior. The front panel 98 is formed with an aperture 106 through which the hollow interior of the enclosure 91 can be viewed, and from which sound exits the enclosure 91 as described below.

Figure 10:
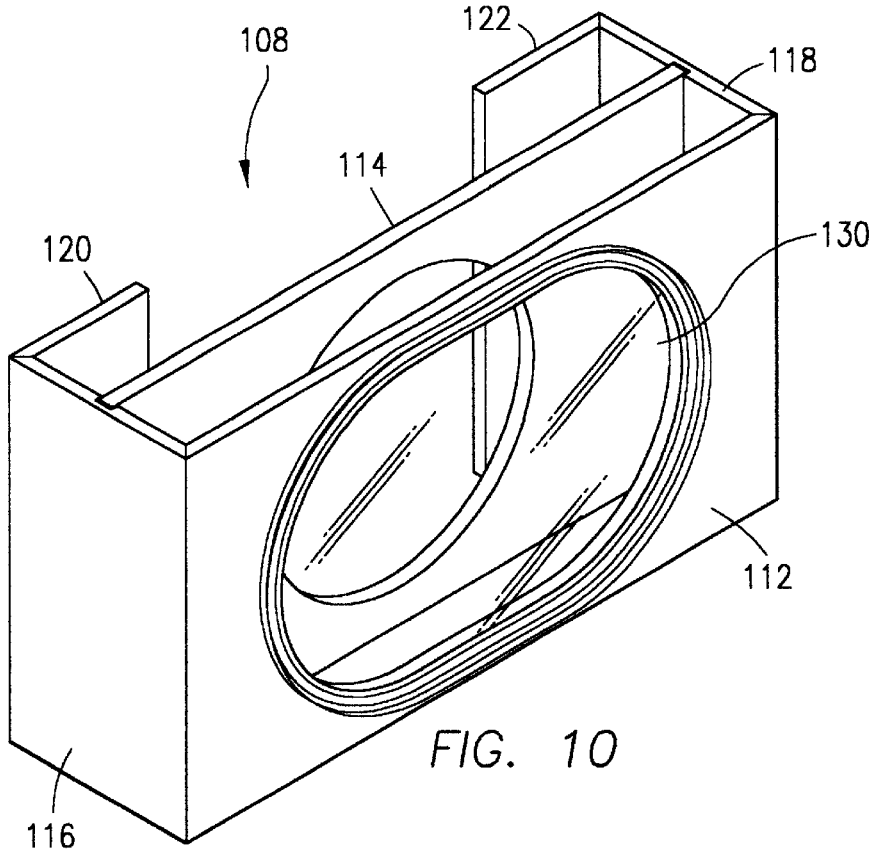
FIG. 10 is a perspective view of the baffle structure of the bandpass enclosure of this invention.

As best seen in FIG. 10, a baffle structure 108 is mounted within the hollow interior of the enclosure 91 to support a loudspeaker 14 and form a flow path for the transmission of sound from the speaker 14 to the aperture 106 in the front panel 98. The baffle structure 108 comprises a front wall 112, an intermediate wall 114 spaced from the front wall 112 and a pair of side walls 116, 118 connected to the ends of each of the front wall 112 and intermediate wall 114. A pair of back walls 120 and 122 are also shown in the Figs., which extend from the side walls 116, 118, respectively, and are spaced from one another. The entire baffle structure 108 is secured within the hollow interior of enclosure 91 by grooves or dados (not shown) formed in the top panel 94 and bottom panel 96, i.e., the top and bottom edges of each wall 112, 114, 116, 118, 120 and 122 are received within and preferably glued to a separate groove in the top and bottom panels 94, 96. As viewed in FIGS. 8 and 9, a space 124 is formed between the back walls 120, 122 of the baffle structure 108 and the back panel 100 of the enclosure 91, a space 126 is formed between each of the side walls 116, 118 of the baffle structure 108 and respective end panels 102, 104 of the enclosure 91 and a space 128 is formed between the front wall 112 of the baffle structure 108 and the front panel 98 of the enclosure 91. These spaces 124, 126 and 128 collectively define a flow path or port leading to the aperture 106 in the front panel 98 of the enclosure 91.

The intermediate wall 114 of the baffle structure 108 is formed with an opening to mount a loudspeaker 14 such that the front of the loudspeaker 14 faces the front wall 112 and its back is located in the space between the back walls 120, 122 of the baffle structure 108. The front wall 112 of the baffle structure 108 is formed with an opening, but it is closed with a transparent cover 130 such as a section of Plexiglas or the like. See FIG. 10. The transparent cover 130 allows the loudspeaker 14 to be viewed from outside of the enclosure 91 through the aperture 106 in the front panel 98. Because each of the front wall 112, intermediate wall 114 and side walls 116, 118 of the baffle structure 108 extend completely between the top and bottom panels 94, 96 of the enclosure 91, a closed cavity 132 is formed in the area between the front wall 112 and intermediate wall 114. The sound propagating from the front of the loudspeaker 14 is therefore captured and confined within the closed cavity 132, and not allowed to exit the enclosure 91.

Sound propagating from the back of the loudspeaker 14 is transmitted along the port formed by the spaces 124, 126 and 128 between the panels of the enclosure 91 and the baffle structure 108, as described above, and exits the enclosure 91 through the aperture 106 in the front panel 98. The cross sectional area of the port is chosen to create a band pass effect in which a relatively high sound pressure level is obtained from the loudspeaker 14 within a predetermined frequency range, and a drop off in the sound pressure level occurs at both a certain lower frequency and higher frequency.

While the "wrap" method of fabrication forms no part of this invention, it is noted that in each of the embodiments of this invention shown in the figures, all of the panels of the housings 10, 50 and 92 as well as the visible surfaces of the baffles 12 and 66, and baffle structure 108, are covered with carpeting to provide a durable and finished appearance. Selected areas of carpeting 90 are shown in the Figs. for purposes of illustration.

While the invention has been described with referenced to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An enclosure for use with at least one loudspeaker which radiates sound in a first direction and in a second direction generally opposite to the first direction, comprising:

a housing including a top panel, a bottom panel, a front panel, a back panel and opposed side panels interconnected to collectively form a hollow interior, one of said panels being formed with an aperture;

a baffle mounted within a hollow interior of said housing, said baffle including a first wall oriented generally parallel to and spaced from said front panel, a second wall mounted to one end of said first wall which extends substantially perpendicular to said first wall and is spaced from one of said side panels, and a third wall mounted to the other end of said first wall which extends substantially perpendicular to said first wall and is spaced from the other of said side panels, said front wall being adapted to mount the at least one loudspeaker in a position to direct sound radiating from the at least one loudspeaker in said first direction toward said aperture, said space between said first wall and said front panel and said spaces between second wall, said third wall and respective side panel collectively forming a port for the transmission of sound radiating in said second direction from the at least one loudspeaker to said departure.

2. The enclosure of claim 1 in which said baffle is adapted to mount one loudspeaker in alignment with said aperture.

3. The enclosure of claim 1 in which said front panel is formed with said aperture, said first wall of said baffle including a common wall connected to a first loudspeaker mounting section and to a second loudspeaker mounting section, each of said first and second loudspeaker mounting sections being adapted to mount one loudspeaker in position to direct sound radiating in said first direction toward said aperture.

4. The enclosure of claim 1 in which at least a portion of said baffle is visible through said aperture in said one panel, at least said visible portion of said baffle and said exterior surface of each of said panels being covered with a carpet material.

5. An enclosure for use with a loudspeaker which radiates sound in a first direction and in a second direction generally opposite to the first direction, comprising:

a housing including a top panel, a bottom panel, a front panel, a back panel and opposed side panels interconnected to collectively form a hollow interior, said front panel being formed with an aperture;

a baffle structure mounted within said hollow interior of said housing which includes a first wall spaced from said front panel of said housing, a second wall spaced from said first wall and opposed third and fourth walls each connected between said first wall and said second wall, a closed cavity being formed by said first wall, said second wall and said opposed third and fourth walls of said baffle structure and said top and bottom panels of said housing, said baffle structure being oriented with respect to said opposed side panels, said front panel and said back panel of said housing form a port communicating with said aperture in said front panel of said housing;

said baffle structure being adapted to mount the loudspeaker within said hollow interior of said housing such that sound radiating in said first direction from the the loudspeaker enters said closed cavity and sound radiating in said second direction from the the loudspeaker enters said port for transmission to said aperture.

6. The enclosure of claim 5 in which said front wall of said baffle structure is formed with an opening covered with a transparent plate.

7. The enclosure of claim 5 in which each of said third and fourth walls of said baffle structure are spaced from respective ones of said opposed side panels of said housing, said space between said first wall and said front panel and said spaces between said third and fourth walls and said opposed side panels collectively forming said port.

8. The enclosure of claim 7 in which said baffle structure further includes a pair of back walls each mounted to one of said third and fourth walls of said baffle structure, said back walls being spaced from said back panel of said housing to form a portion of said port.

9. The enclosure of claim 5 in which at least a portion of said baffle is visible through said aperture in said one panel, at least said visible portion of said baffle and said exterior surface of each of said panels being covered with a carpet material.

10. An enclosure for use with a loudspeaker which radiates sound in a first direction and in a second direction generally opposite to the first direction, comprising:

a housing including a top panel, a bottom panel, a front panel, a back panel and opposed side panels interconnected to collectively form a hollow interior, said front panel being formed with an aperture;

a baffle structure located within said hollow interior, including:

(i) a front wall spaced from said front panel of said housing;

(ii) an intermediate wall spaced from and oriented generally parallel to said front wall, said intermediate wall being adapted to mount a loudspeaker;

(iii) a pair of side walls each connected substantially perpendicular to said front wall and to said intermediate wall, said front wall, said intermediate wall and said opposed side walls forming a closed cavity with said top panel and bottom panel of said housing, said closed cavity receiving sound radiating in a first direction from the loudspeaker;

said baffle structure being oriented relative to said opposed side panels, said front panel and said back panel of said housing to form a port therebetween for the transmission of sound radiating in said second direction from the loudspeaker to said aperture in said front panel of said housing.

11. The enclosure of claim 10 in which said front wall of said baffle structure is formed with an opening covered with a transparent plate.

12. The enclosure of claim 10 in which each of said opposed side walls of said baffle structure are spaced from respective ones of said opposed side panels of said housing, said space between said front wall of said baffle structure and said spaces between said opposed side walls and opposed side panels collectively forming said port.

13. The enclosure of claim 12 in which said baffle structure further includes a pair of back walls each mounted to one of said side walls, said back walls being spaced from said back panel of said housing to form a portion of said port.

14. The enclosure of claim 10 in which at least a portion of said baffle is visible through said aperture in said one panel, at least said visible portion of said baffle and said exterior surface of each of said panels being covered with a carpet material.

15. An enclosure for use with at least one loudspeaker which radiates sound in a first direction and in a second direction generally opposite to the first direction, comprising:

a housing including a top panel, a bottom panel, a front panel, a back panel and opposed side panels, interconnected to collectively form a hollow interior, one of said panels being formed with an aperture;

a baffle mounted within said hollow interior of said housing, said baffle including a common wall connected to a first loudspeaker mounting section and to a second loudspeaker mounting section, each of said first and second loudspeaker mounting sections including a first wall adapted to mount the loudspeaker in position to direct sound radiating in said first direction toward said aperture and a second wall connected to said first wall, said baffle being oriented within said hollow interior to form a port for the transmission of sound radiating in said second direction from the loudspeakers to said aperture.

16. The enclosure of claim 3 in which each of said first and second loudspeaker mounting sections has a tapered portion adapted to support the loudspeaker and an intermediate portion oriented generally parallel to said front panel.

17. The enclosure of claim 16 in which said first wall of each of said first and second loudspeaker mounting sections of said baffle is spaced from said front panel of said enclosure, and said second wall of each of said first and second loudspeaker mounting sections of said baffle is spaced from one of said side panels of said enclosure, said port including a first port formed by said spaces between said walls of said first loudspeaker mounting section of said baffle and said panels of said housing for the transmission of sound radiating in said second direction from one of the loudspeakers to said aperture and a second port formed by said spaces between said walls of said second loudspeaker mounting section of said baffle and said panels of said housing for the transmission of sound radiating in said second direction from the other of the loudspeakers to said aperture.

18. The enclosure of claim 15 in which at least a portion of said baffle is visible through said aperture in said one panel, at least said visible portion of said baffle and said exterior surface of each of said panels being covered with a carpet material.

* * * * *